US010030501B2

(12) United States Patent
Logan et al.

(10) Patent No.: US 10,030,501 B2
(45) Date of Patent: Jul. 24, 2018

(54) DOWNHOLE PROBE CENTRALIZER

(71) Applicant: EVOLUTION ENGINEERING INC., Calgary (CA)

(72) Inventors: Aaron W. Logan, Calgary (CA); Justin C. Logan, Calgary (CA); Patrick R. Derkacz, Calgary (CA)

(73) Assignee: Evolution Engineering Inc., Calgary (CA)

( * ) Notice: Subject to any disclaimer, the term of this patent is extended or adjusted under 35 U.S.C. 154(b) by 493 days.

(21) Appl. No.: 14/649,506

(22) PCT Filed: Dec. 3, 2012

(86) PCT No.: PCT/CA2012/050870
§ 371 (c)(1),
(2) Date: Jun. 3, 2015

(87) PCT Pub. No.: WO2014/085894
PCT Pub. Date: Jun. 12, 2014

(65) Prior Publication Data
US 2015/0369035 A1 Dec. 24, 2015

(51) Int. Cl.
*E21B 47/01* (2012.01)
*E21B 17/10* (2006.01)

(52) U.S. Cl.
CPC ..... *E21B 47/01* (2013.01); *E21B 17/1078* (2013.01); *E21B 47/011* (2013.01)

(58) Field of Classification Search
CPC .... E21B 47/01; E21B 17/1078; E21B 47/011; E21B 17/10; E21B 17/1042; E21B 17/1014
See application file for complete search history.

(56) References Cited

U.S. PATENT DOCUMENTS

| | | | |
|---|---|---|---|
| 2,715,552 | A | 8/1955 | Lane |
| 3,197,262 | A | 7/1965 | Fairchild |
| 3,323,327 | A | 6/1967 | Leathers et al. |
| 3,982,431 | A | 9/1976 | Grosso et al. |
| 4,013,945 | A | 3/1977 | Grosso |
| 4,021,774 | A | 5/1977 | Asmundsson et al. |
| 4,216,536 | A | 8/1980 | More |
| 4,351,116 | A | 9/1982 | Scott, Jr. |
| 4,468,762 | A | 8/1984 | Jurgens |

(Continued)

FOREIGN PATENT DOCUMENTS

| | | | |
|---|---|---|---|
| CA | 2544457 | C | 10/2007 |
| EP | 1248896 | B1 | 4/2006 |

(Continued)

*Primary Examiner* — Michael R Wills, III
(74) *Attorney, Agent, or Firm* — Oyen Wiggs Green & Mutala LLP

(57) ABSTRACT

An assembly for use in subsurface drilling includes a downhole probe supported in a drill string section by centralizing features of a centralizer that is slidably removable from the drill string section. The centralizer may comprise a tubular body having a bore defined through it. A bore wall of the centralizer is fluted to provide inward contact points that support the downhole probe. The downhole probe may be supported for substantially its entire length. The centralizer may optionally comprise and/or be coated with a vibration damping and/or electrically insulating material.

61 Claims, 7 Drawing Sheets

(56) References Cited

U.S. PATENT DOCUMENTS

| | | | |
|---|---|---|---|
| 4,537,067 | A | 8/1985 | Sharp et al. |
| 4,571,215 | A | 2/1986 | Hansen |
| 4,684,946 | A | 8/1987 | Issenmann |
| 4,734,893 | A | 3/1988 | Claycomb |
| 4,862,425 | A | 8/1989 | Cretin et al. |
| 4,901,289 | A | 2/1990 | Cretin et al. |
| 4,938,299 | A | 7/1990 | Jelsma |
| 5,064,006 | A | 11/1991 | Waters et al. |
| 5,160,925 | A | 11/1992 | Dailey et al. |
| 5,236,048 | A | 8/1993 | Skinner et al. |
| 5,247,990 | A | 9/1993 | Sudol et al. |
| 5,294,923 | A | 3/1994 | Juergens et al. |
| 5,333,686 | A | 8/1994 | Vaughan et al. |
| 5,474,132 | A | 12/1995 | Gallagher |
| 5,520,246 | A | 5/1996 | Van Steenwyk et al. |
| 5,678,630 | A | 10/1997 | Shaw et al. |
| 5,795,991 | A | 8/1998 | Hesse et al. |
| 6,429,653 | B1 | 8/2002 | Kruspe et al. |
| 6,446,736 | B1 | 9/2002 | Kruspe et al. |
| 6,750,783 | B2 | 6/2004 | Rodney |
| 7,151,466 | B2 | 12/2006 | Gabelmann et al. |
| 7,243,028 | B2 | 7/2007 | Young et al. |
| 7,604,059 | B2 | 10/2009 | Thornton |
| 8,020,634 | B2 | 9/2011 | Utter et al. |
| 8,201,645 | B2 | 6/2012 | Hall et al. |
| 8,251,160 | B2 | 8/2012 | Gopalan et al. |
| 8,284,073 | B2 | 10/2012 | Mehta et al. |
| 8,474,548 | B1 | 7/2013 | Young et al. |
| 2005/0217898 | A1 | 10/2005 | Clark |
| 2006/0202852 | A1 | 9/2006 | Peter et al. |
| 2007/0235224 | A1 | 10/2007 | Koger |
| 2008/0245570 | A1 | 10/2008 | Partouche |
| 2009/0023502 | A1 | 1/2009 | Koger |
| 2009/0267790 | A1 | 10/2009 | Hall et al. |
| 2012/0175131 | A1 | 7/2012 | Johnson et al. |
| 2013/0133882 | A1 | 5/2013 | Harms et al. |
| 2015/0267481 | A1* | 9/2015 | Logan ..... E21B 7/04 175/40 |

FOREIGN PATENT DOCUMENTS

| | | | |
|---|---|---|---|
| WO | 2006083764 | A1 | 8/2006 |
| WO | 2008116077 | A2 | 9/2008 |
| WO | 2009048768 | A2 | 4/2009 |
| WO | 2012045698 | A1 | 4/2012 |
| WO | 2012082748 | A2 | 6/2012 |

* cited by examiner

DOWNHOLE PROBE CENTRALIZER

TECHNICAL FIELD

This invention relates to subsurface drilling, more specifically to systems for supporting downhole probes. Embodiments are applicable to drilling wells for recovering hydrocarbons.

BACKGROUND

Recovering hydrocarbons from subterranean zones typically involves drilling wellbores.

Wellbores are made using surface-located drilling equipment which drives a drill string that eventually extends from the surface equipment to the formation or subterranean zone of interest. The drill string can extend thousands of feet or meters below the surface. The terminal end of the drill string includes a drill bit for drilling (or extending) the wellbore. Drilling fluid usually in the form of a drilling "mud" is typically pumped through the drill string. The drilling fluid cools and lubricates the drill bit and also carries cuttings back to the surface. Drilling fluid may also be used to help control bottom hole pressure to inhibit hydrocarbon influx from the formation into the wellbore and potential blow out at the surface.

Bottom hole assembly (BHA) is the name given to the equipment at the terminal end of a drill string. In addition to a drill bit a BHA may comprise elements such as: apparatus for steering the direction of the drilling (e.g. a steerable downhole mud motor or rotary steerable system); sensors for measuring properties of the surrounding geological formations (e.g. sensors for use in well logging); sensors for measuring downhole conditions as drilling progresses; one or more systems for telemetry of data to the surface; stabilizers; heavy weight drill collars, pulsers and the like. The BHA is typically advanced into the wellbore by a string of metallic tubulars (drill pipe).

Modern drilling systems may include any of a wide range of electronics systems in the BHA or at other downhole locations. such electronics systems may be packaged as part of a downhole probe. A downhole probe may comprise any active mechanical, electronic, and/or electromechanical system that operates downhole. A probe may provide any of a wide range of functions including, without limitation, data acquisition, measuring properties of the surrounding geological formations (e.g. well logging), measuring downhole conditions as drilling progresses, controlling downhole equipment, monitoring status of downhole equipment, measuring properties of downhole fluids and the like. A probe may comprise one or more systems for: telemetry of data to the surface; collecting data by way of sensors (e.g. sensors for use in well logging) that may include one or more of vibration sensors, magnetometers, inclinometers, accelerometers, nuclear particle detectors, electromagnetic detectors, acoustic detectors, and others; acquiring images; measuring fluid flow; determining directions; emitting signals, particles or fields for detection by other devices; interfacing to other downhole equipment; sampling downhole fluids, etc. Some downhole probes are highly specialized and expensive.

Downhole conditions can be harsh. Exposure to these harsh conditions, which can include high temperatures, vibrations, turbulence and pulsations in the flow of drilling fluid past the probe, shocks, and immersion in various drilling fluids at high pressures can shorten the lifespan of downhole probes and increase the probability that a downhole probe will fail in use. Supporting and protecting downhole probes is important as a downhole probe may be subjected to high pressures (20,000 p.s.i. or more in some cases), along with severe shocks and vibrations. Replacing a downhole probe that fails while drilling can involve very great expense.

The following references include descriptions of various downhole probes and centralizers that may be useful for supporting a downhole probe in a bore within a drill string: US2007/0235224; US2005/0217898; U.S. Pat. No. 6,429,653; U.S. Pat. No. 3,323,327; U.S. Pat. No. 4,571,215; U.S. Pat. No. 4,684,946; U.S. Pat. No. 4,938,299; U.S. Pat. No. 5,236,048; U.S. Pat. No. 5,247,990; U.S. Pat. No. 5,474,132; U.S. Pat. No. 5,520,246; U.S. Pat. No. 6,429,653; U.S. Pat. No. 6,446,736; U.S. Pat. No. 6,750,783; U.S. Pat. No. 7,151,466; U.S. Pat. No. 7,243,028; US2009/0023502; WO2006/083764; WO2008/116077; WO2012/045698; and WO2012/082748.

US 2007/0235224 describes an elastomeric tubular liner that is secured to the inner surface of a tubular member. The tubular liner is molded in place in the bore of the tubular member. The tubular liner can be removed by drilling, burning or melting.

US 2005/0217898 describes a drill collar for damping downhole vibration in the tool-housing region of a drill string. The collar comprises a hollow cylindrical sleeve having a longitudinal axis and an inner surface facing the longitudinal axis. Multiple elongate ribs are bonded to the inner surface and extend parallel to the longitudinal axis.

There remains a need for cost-effective and easily serviceable ways to support downhole probes, which may include electronics systems of a wide range of types at downhole locations in a way that provides at least some protection against mechanical shocks and vibrations and other downhole conditions.

SUMMARY

The invention has a number of aspects. One aspect provides downhole apparatus that includes a downhole probe as may be used, for example in subsurface drilling supported by a centralizer. Other aspects of the invention provide downhole apparatus and systems that include centralizing features and associated methods.

One example aspect of the invention provides a downhole assembly comprising a drill string section having a bore extending longitudinally through the drill string section and a downhole probe located in the bore of the section. A centralizer is provided within the bore of the drill string section. The centralizer comprises centralizing features extending inwardly into a bore of the centralizer. The centralizing features support the downhole probe in the bore. The centralizing features are arranged to provide passages for the flow of drilling fluid around an outside of the downhole probe between the centralizing features. In some embodiments the centralizer comprises a cylindrical tubular body and the centralizing features are integral with the body. In some embodiments the section comprises a steel drill collar and the body of the centralizer fits against the bore wall such that the centralizing features are supported by the bore wall. The centralizing features may, for example, have the form of rounded lobes in transverse cross section. The centralizing features may have the form of ridges that extend longitudinally along the centralizer or a part thereof. In some embodiments the centralizing features are configured as helical structures that extend along and around a bore of the centralizer.

Another aspect of the invention provides subsurface drilling methods. The methods comprise inserting a downhole probe and a centralizer into a drill string section. The centralizer comprises centralizing features extending radially inwardly to contact the downhole probe. The centralizing features are integral with a tubular body of the centralizer. Inserting the probe comprises sliding the probe longitudinally into a bore of the centralizer between the centralizing features and then securing the probe against longitudinal movement relative to the drill string section. The method further comprises coupling the drill string section into a drill string and lowering the probe into a borehole as drilling advances.

Another aspect provides a downhole assembly comprising a drill string section having a bore extending longitudinally through the drill string section and a tubular centralizer removably disposed in the bore of the drill string section. The centralizer may be easily removable by sliding it out from the drill string section. In some embodiments the centralizer is dimensioned for a slip fit in the drill string section. The centralizer comprises a cylindrical body having a bore extending longitudinally from an uphole end of the centralizer to a downhole end of the centralizer. a downhole probe is located in the bore of the centralizer. The centralizer comprises centralizing ridges extending inwardly into the bore of the centralizer to contact the downhole probe and support the downhole probe in the bore of the centralizer. The centralizing ridges being arranged to provide passages for the flow of drilling fluid around an outside of the downhole probe between the centralizing ridges.

Further aspects of the invention and non-limiting example embodiments of the invention are illustrated in the accompanying drawings and/or described in the following description.

BRIEF DESCRIPTION OF THE DRAWINGS

The accompanying drawings illustrate non-limiting example embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

Figure 1:
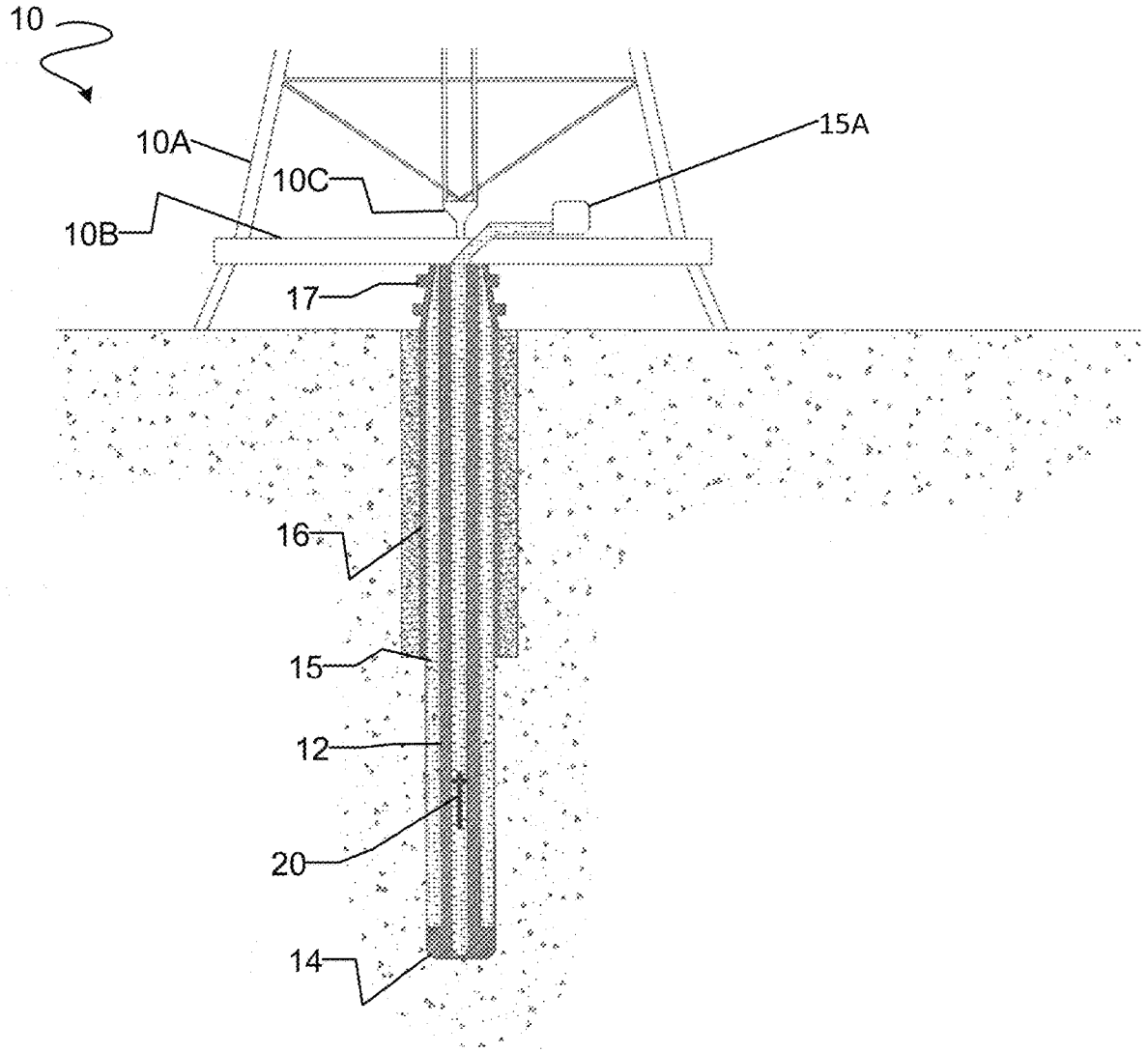
FIG. 1 is a schematic view of a drilling operation according to one embodiment of the invention.

FIG. 1 shows schematically an example drilling operation. A drill rig 10 drives a drill string 12 which includes sections of drill pipe that extend to a drill bit 14. The illustrated drill rig 10 includes a derrick 10A, a rig floor 10B and draw works 10C for supporting the drill string. Drill bit 14 is larger in diameter than the drill string above the drill bit. An annular region 15 surrounding the drill string is typically filled with drilling fluid. The drilling fluid is pumped by a pump 15A through a bore in the drill string to the drill bit and returns to the surface through annular region 15 carrying cuttings from the drilling operation. As the well is drilled, a casing 16 may be made in the well bore. A blow out preventer 17 is supported at a top end of the casing. The drill rig illustrated in FIG. 1 is an example only. The methods and apparatus described herein are not specific to any particular type of drill rig.

Drill string 12 includes a downhole probe 20. Here the term 'probe' encompasses any active mechanical, electronic, and/or electromechanical system. A probe may provide any of a wide range of functions including, without limitation, data acquisition, sensing, data telemetry, control of downhole equipment, status monitoring for downhole equipment, collecting data by way of sensors that may include one or more of vibration sensors, magnetometers, nuclear particle detectors, electromagnetic detectors, acoustic detectors, and others, emitting signals, particles or fields for detection by other devices, etc. Some downhole probes are highly specialized and expensive. Downhole conditions can be harsh. Exposure to these harsh conditions, which can include high temperatures, vibrations, shocks, and immersion in various drilling fluids can shorten the lifespan of downhole probes.

The following description describes an electronics package 22 which is one example of a downhole probe. Electronics package 22 comprises a housing enclosing electric circuits and components providing desired functions. However, the invention may be applied to support downhole probes of any types and is not restricted to downhole probes that include electronic systems. In some embodiments a downhole probe comprising mechanical or other non-electronic systems is supported in place of electronics package 22.

The housing of electronics package 22 typically comprises an elongated cylindrical body that contains within it electronic systems or other active components of the downhole probe. The body may, for example, comprise a metal tube designed to withstand downhole conditions. The body may, for example, have a length in the range of 1 to 20 meters.

Downhole electronics package 22 may optionally include a telemetry system for communicating information to the surface in any suitable manner. In some example embodiments a telemetry system is an electromagnetic (EM) telemetry system however, where telemetry is provided, other modes of telemetry may be provided instead of or in addition to EM telemetry.

Figure 2:
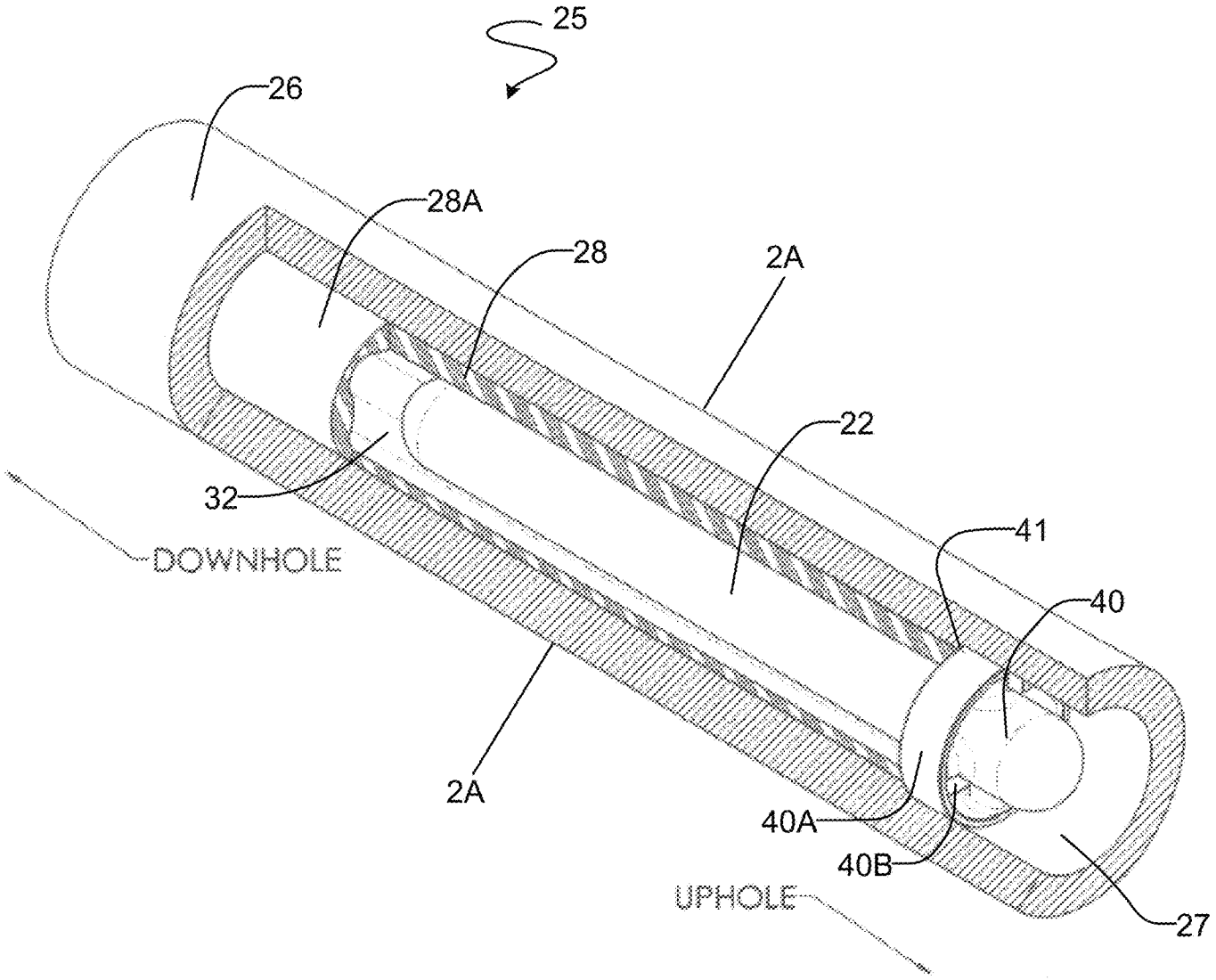
FIG. 2 is a perspective cutaway view of a downhole assembly containing an electronics package.
Figure 2A:
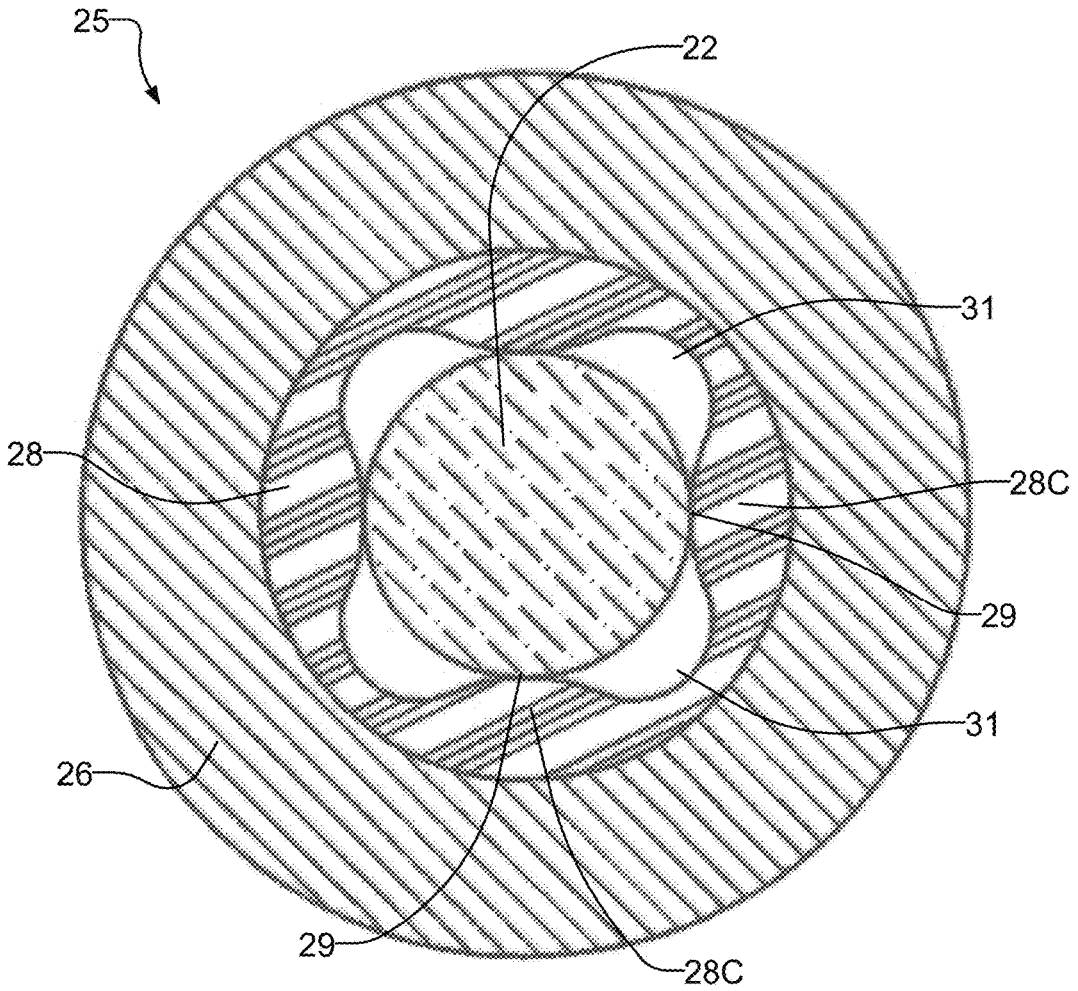
FIG. 2A is a view taken in section along the line 2A-2A of FIG. 2.

FIGS. 2 and 2A show a downhole assembly 25 comprising an electronics package 22 supported within a bore 27 in a section 26 of drill string. Section 26 may, for example, comprise a drill collar, a gap sub or the like. Section 26 may comprise a single component or a number of components that are coupled together and are designed to allow section 26 to be disassembled into its component parts if desired. For example, section 26 may comprise a plurality of collars coupled together by threaded or other couplings.

Figure 2B:
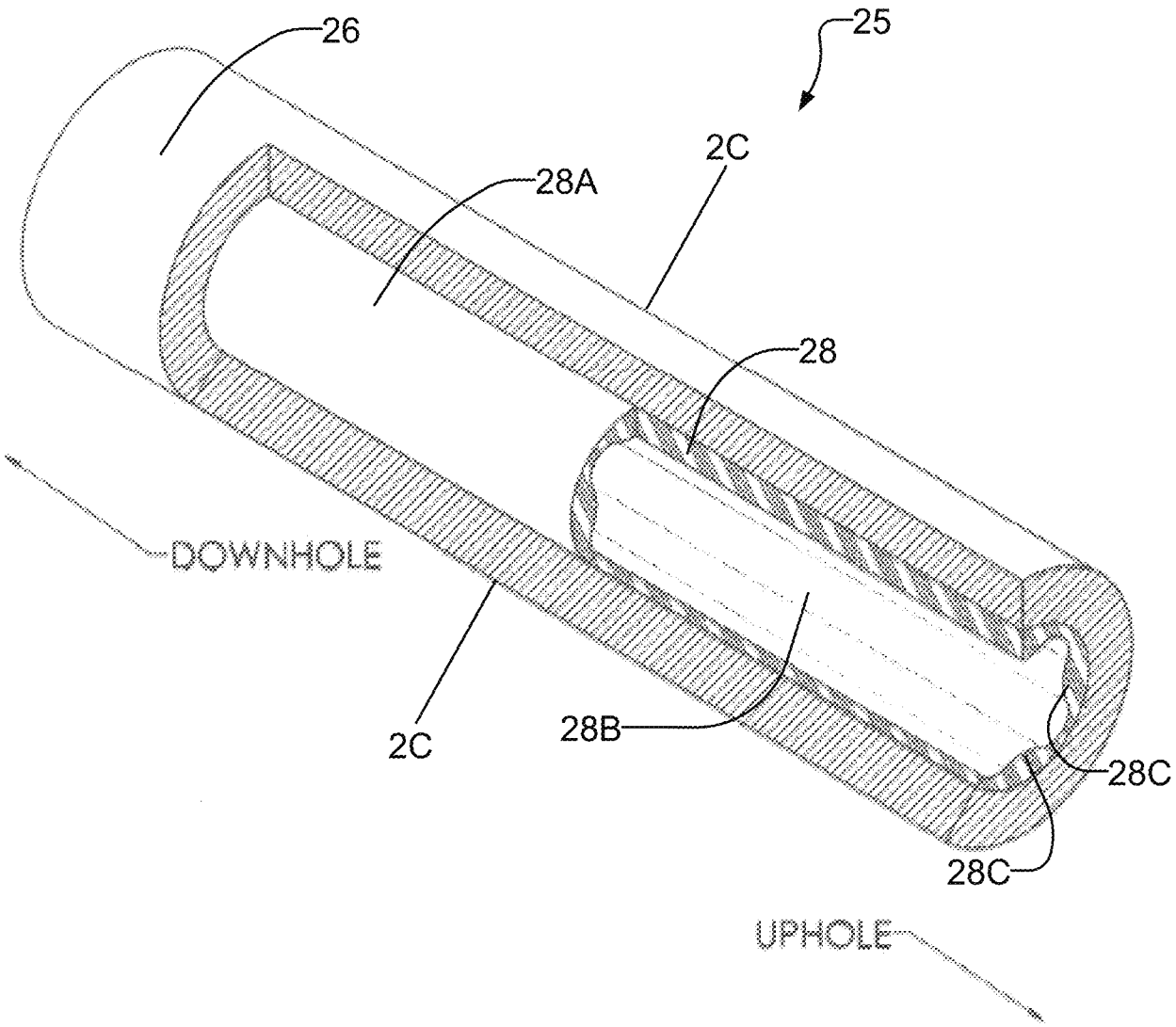
FIG. 2B is a perspective cutaway view of a downhole assembly not containing an electronics package.
Figure 2C:
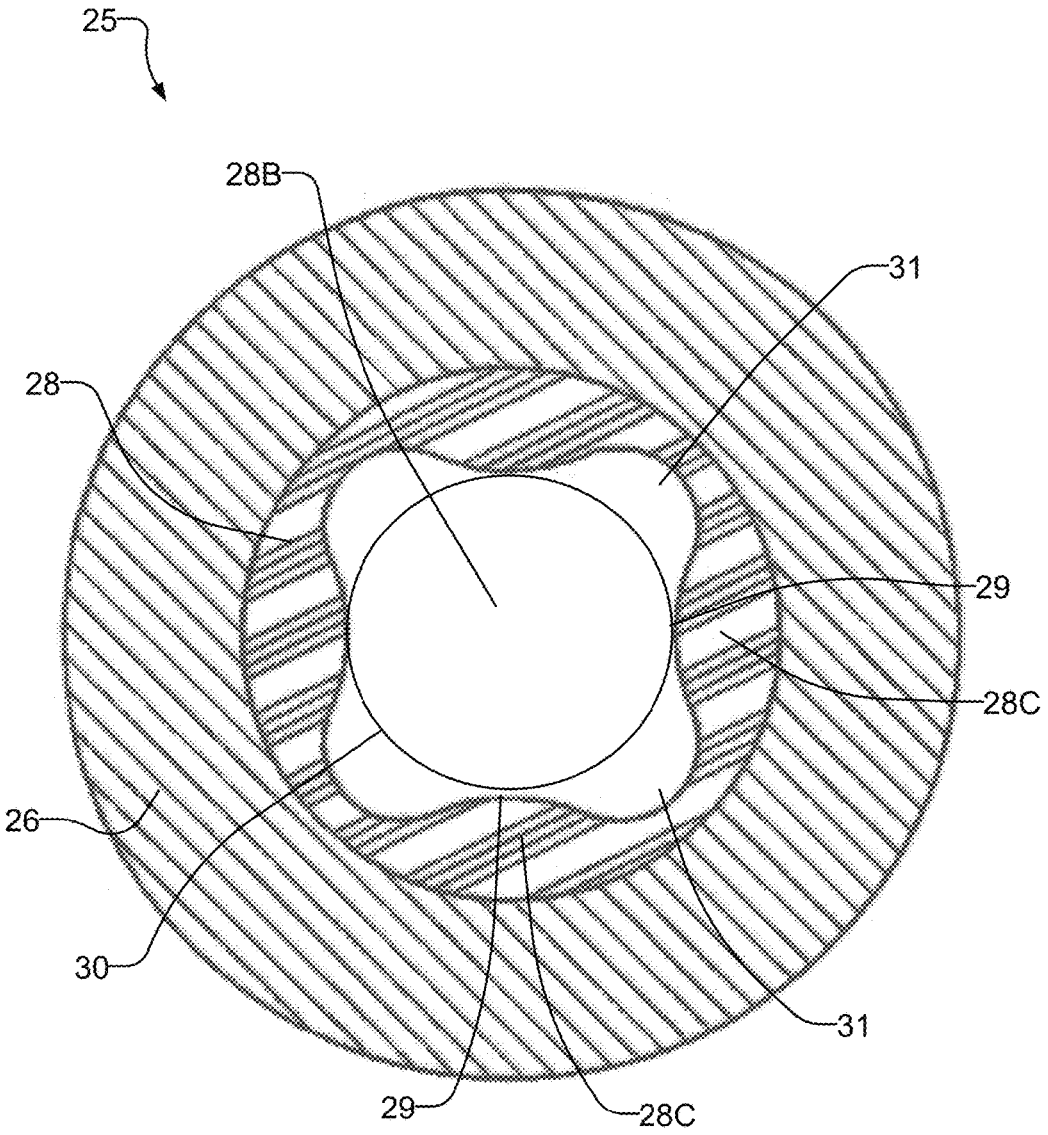
FIG. 2C is a view taken in section along the line 2C-2C of FIG. 2B.

Electronics package 22 is smaller in diameter than bore 27. Electronics package is centralized within bore 27 by features of a centralizer 28 provided within bore 27 of section 26. FIGS. 2B and 2C show the downhole assembly 25 without an electronics package 22 to better show the centralizing features.

Centralizer 28 is formed to have an outer surface 28A dimensioned to be removably insertable into bore 27. Centralizer 28 may, for example, comprise an extruded form dimensioned for insertion into bore 27. The fit between centralizer 28 and bore 27 should be tight enough that centralizer 28 cannot rattle about within bore 27 and yet not so tight that it is difficult to insert centralizer 28 into bore 27.

Centralizer 28 may be made from a range of materials from metals to plastics suitable for exposure to downhole conditions. For example centralizer 28 may be made from a suitable grade of PEEK (Polyetheretherketone) or PET (Polyethylene terephthalate) plastic. Where centralizer 28 is made of plastic the plastic may be fiber-filled (e.g. with glass fibers) for enhanced erosion resistance, structural stability and strength.

The material of centralizer 28 should be capable of withstanding downhole conditions without degradation. The ideal material can withstand temperature of up to at least 150 C (preferably 175 C or 200 C or more), is chemically resistant or inert to any drilling fluid to which it will be exposed, does not absorb fluid to any significant degree and resists erosion by drilling fluid. In cases where centralizer 28 contacts metal of electronics package 22 and/or bore 27 (e.g. where one or both of electronics package 22 and bore 27 is uncoated) the material of centralizer 28 is preferably not harder than the metal of electronics package 22 and/or section 26 that it contacts. Centralizer 28 is preferably stiff against deformations so that electronics package 22 is kept concentric within bore 27 and is mechanically coupled to section 26. The material characteristics of centralizer 28 may be uniform.

The material of centralizer 28 may also be selected for compatibility with sensors associated with electronics package 22. For example, where electronics package 22 includes a magnetometer, it is desirable that centralizer 28 be made of a non-magnetic material.

Centralizer 28 has a longitudinally-extending bore 28B within which electronics package 22 is received and supported. As shown in FIGS. 2A, 2B, and 2C, centralizer 28 is provided with centralizing features 28C that project radially-inwardly into bore 28B. Features 28C are integral with the material of centralizer 28. For example, where centralizer 28 is made of an extruded thermoplastic, features 28C may comprise inwardly-extending ribs that are co-extruded with the rest of centralizer 28.

Centralizing features 28C are arranged to project inwardly far enough to support electronics package 22 (or any other downhole probe). Features 28C are circumferentially spaced apart around bore 28B such that electronics package 22 is supported against being displaced in any direction transverse to section 26.

Centralizing features 28C are dimensioned to accommodate an electronics package 22 to be supported between them. In some embodiments one or both of centralizing features 28C and/or the outer surface of electronics package 22 are coated with a layer of a damping material. The damping layer may comprise a material that is more compressible than the material of centralizer 28. The damping layer may comprise a material that has a hardness less than that of the outer surfaces of electronics package 22 and features 28C. Some example materials that may be used as a damping layer are materials such as plastic, thermoplastic, elastomers and rubber. In embodiments which provide a damping layer between the downhole probe and centralizing features 28C the thickness of such material layers is taken into account in dimensioning centralizing features 28C so as to provide a desired snug fit of the downhole probe between centralizing features 28C. The damping layer, if present, may have a uniform thickness but this is not mandatory.

In some applications it is advantageous for electronics package 22 to be electrically insulated from section 26. For example, where electronics package 22 comprises an EM telemetry system, it may be necessary to electrically isolate parts of the housing of electronics package 22 from parts of section 26 (which may comprise a gap sub). In such applications, centralizer 28 may be made of and/or coated with an electrically insulating material.

In some embodiments, centralizing features 28C extend longitudinally along bore 28B such that centralizing features 28C can contact electronics package 22 continuously over a significant portion of the length of electronics package 22. Centralizer 28 with longitudinally-extending integrated centralizing features 28C as shown, for example, in FIG. 2B can be described as providing a bore 28B which is non-round in cross-section. Radially innermost areas on the bore wall (corresponding to the inward ends of centralizing features 28C) provide support for an electronics package 22 or other downhole probe either by bearing directly on a wall of the probe or on a vibration damping layer between the probe and the support areas. The support areas are spaced circumferentially around the probe. Between neighboring circumferentially-spaced support areas the bore wall of bore 28B follows a path that is radially spaced apart from the outer surface of the probe to provide channels extending generally longitudinally in centralizer 28. A centralizer 28 as shown in the drawings has a reduced wall thickness in areas corresponding to the channels. The wall thickness of centralizer 28 may be relatively large at locations corresponding to centralizing features 28C and may be relatively small at locations corresponding to valleys 31 running between circumferentially-adjacent centralizing features 28C.

Drilling fluid or other fluid in bore 27 can flow past electronics package 22 in these channels.

A damping layer may be provided by applying a coating or otherwise applying a layer to the downhole probe and/or centralizing features 28C. A damping layer may also be provided as a separate component that extends along the probe and is located between the probe and centralizing features 28C. It is not mandatory that the damping layer be bonded or otherwise adhered to either of the downhole probe or centralizing features 28C. For example, a damping layer may be provided in the form of a tubular structure that extends around the downhole probe and is compressed between centralizing features 28C and the surface of the downhole probe. Such a damping layer may be made, for example by injection molding or extrusion. Such a damping layer may follow the profile of the wall of bore 28B (including centralizing features 28C) or may follow the profile of the outside of the downhole probe.

A removable damping layer, where provided, may be removable from within centralizer 28 without drilling, heating or burning it out. Rotational movement of the damping layer, if not bonded to the inner surface of centralizer 28 may be restricted by centralizing features 28C and/or by the damping being pinched between centralizing features 28C and electronics package 22.

It is beneficial for electronics package 22 to sit between the innermost points of centralizing features 28C with a size-on-size fit (e.g. a transition fit or tight tolerance sliding fit) or a slight interference fit. FIG. 2 shows a damping layer 32 on the inner surface of centralizer 28.

In some embodiments either one or both of outer surface 28A and/or bore 27 are coated with a layer of damping material. The damping layer may comprise a material that is more compressible than the material of centralizer 28 and/or section 26. The damping layer may comprise a material that has a hardness less than that of outer surface 28A and/or section 26. Some example materials that may be used as a damping layer are materials such as plastic, thermoplastic, elastomers and rubber. In embodiments which provide a damping layer between outer surface 28A and bore 27 the thickness of such material layers is taken into account in dimensioning centralizer 28 so as to provide a desired snug fit of centralizer 28 within bore 27. In some embodiments, the diameter of outer surface 28A is about ⅛ inch to about ¼ inch smaller than the diameter of bore 27 in order to provide room for a damping layer. The damping layer, if present, may have a uniform thickness but this is not mandatory.

A damping layer may be provided by applying a coating or otherwise applying a layer to outer surface 28A and/or bore 27. A damping layer may also be provided as a separate component (e.g. a tube or sleeve) that extends along centralizer 28 and is located between centralizer 28 and section 26. It is possible but not mandatory that the damping layer be bonded or otherwise adhered to either of the outer surface 28A or bore 27. For example, a damping layer may be provided in the form of a tubular structure that extends around outer surface 28A. Such a damping layer may be made, for example, by injection molding or extrusion.

In some embodiments, there may be damping layers between centralizer 28 and electronics package 22, and between centralizer 28 and section 26. In some embodiments, there may be a damping layer between centralizer 28 and electronics package 22, but no damping layer between centralizer 28 and section 26. In some embodiments, there may be a damping layer between centralizer 28 and section 26, but no damping layer between centralizer 28 and electronics package 22. In some embodiments, there may be no damping layers between centralizer 28 and section 26, or between centralizer 28 and electronics package 22.

In some embodiments, centralizer 28 is made of extruded aluminum, outer surface 28A is coated with a damping layer, and there is no damping layer between centralizer 28 and electronics package 22. Such embodiments are advantageous since a coating may readily be provided to the outer surface 28A of centralizer 28 by e.g. spraying, dipping or other coating techniques. Aluminum may be significantly softer than the material of the outer surface of electronics package 22.

Providing a structure in which the material of centralizer 28 extends to support electronics package 22 with a fit having little, if any clearance provides good mechanical coupling between electronics package 22 and centralizer 28. Providing a centralizer 28 that fits snugly into bore 27 of section 26 in turn provides good mechanical coupling between centralizer 28 and section 26.

As section 26 is typically very massive and rigid compared to electronics package 22, this tight mechanical coupling helps to prevent electronics package 22 from vibrating in modes having lower frequencies. Downhole locations can be subject to high amplitude low frequency vibrations. The tight coupling of electronics package 22 to section 26 by way of centralizer 28 can significantly reduce the vibrations of electronics package 22. Mechanically coupling electronics package 22 to section 26 continuously along its length can substantially reduce flexing and vibration of electronics package 22 caused by lateral accelerations of the drill string, flow of drilling fluid, or the like.

In the illustrated embodiment, centralizing features 28C comprise ridges 29 that extend longitudinally within bore 28B. As shown in FIG. 2C, the innermost points of ridges 29 lie on a circle 30 that defines a centralized location for electronics package 22. Valleys 31 between ridges 29 provide channels within which drilling fluid or other fluids can flow through bore 28B past electronics package 22.

Ridges 29 and/or other centralizing features 28C may extend to support any desired part of electronics package 22. Ridges 29 may be interrupted or continuous. In some embodiments, ridges 29 extend to support electronics package 22 substantially continuously along at least 60% or 70% or 80% of an unsupported portion of electronics package 22 (e.g. a portion of electronics package 22 extending from a point at which electronics package 22 is coupled to section 26 to an end of electronics package 22). In some embodiments centralizer 28 engages substantially all of the unsupported portion of electronics package 22. Here, 'substantially all' means at least 95%. In some embodiments, ridges 29 extend to support electronics package 22 for substantially the full length of electronics package 22.

In the illustrated embodiment, ridges 29 take the form of rounded lobes that extend longitudinally within bore 28B. Rounded lobes as shown advantageously do not provide sharp corners at which cracks could have an increased tendency to occur. In other embodiments ridges 29 may have other shapes.

Figure 4:
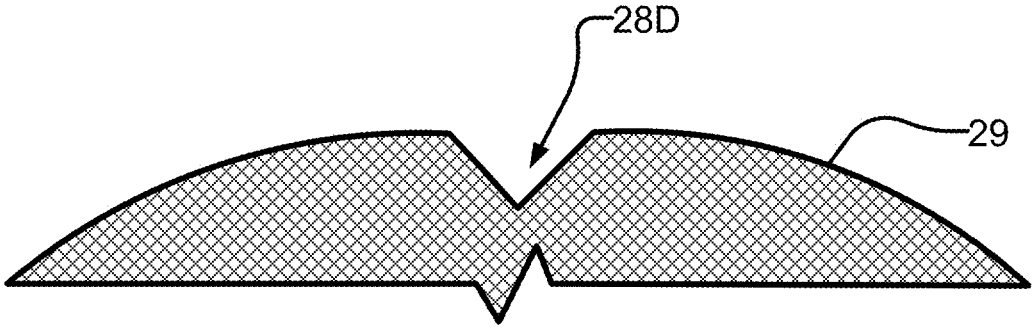
FIG. 4 is a schematic view of a centralizer ridge comprising a V-groove.

In the illustrated embodiment, electronics package 22 is supported by four ridges 29. However, other embodiments may have more or fewer ridges. For example, some alternative embodiments have 3 to 8 ridges 29. The configuration of the innermost parts of ridges 29 that interface to electronics package 22 may be varied. In the illustrated embodiment, ridges 29 present gently-curved inwardly-convex surfaces to electronics package 22. In other embodiments, the innermost ends of ridges 29 may be formed to provide V-grooves 28D to receive electronics package 22, as shown in FIG. 4, or may have other shapes such as channels that conform to the outer surface of electronics package 22.

It is convenient but not mandatory to make centralizing features 28C symmetrical to one another. It is also convenient but not mandatory to make the cross-section of centralizer 28, including centralizing features 28C, mirror symmetrical about an axis passing through one of ridges 29. It is convenient but not mandatory for ridges 29 to extend parallel to the longitudinal axis of centralizer 28. In the alternative, centralizer ridges 29 may be formed to spiral helically around the inner wall of bore 27 (like rifling in a rifle barrel). Where centralizing features 28C are in the form of helical ridges, as few as two ridges 29 that spiral around the bore 28B of centralizer 28 may be provided. In other embodiments centralizing features 28C are configured to provide 3 to 8 helical ridges that spiral about the bore of centralizer 28.

As noted above, a layer of a vibration damping material such as rubber, an elastomer, a thermoplastic or the like may be provided between electronics package 22 and centralizing features 28C. The vibration damping material may assist in preventing 'pinging' (high frequency vibrations of electronics package 22 resulting from shocks). The vibration damping material may, for example, comprise a layer or coating of rubber, a suitable plastic or the like.

Where section 26 comprises a gap sub, the gap sub may have an electrically-conducting uphole part, an electrically-conducting downhole part and an electrically insulating part between the uphole and downhole parts. Electronics package 22 may extend across the electrically insulating part of the gap sub. An electrically-insulating centralizer 28, as described herein may bridge between the uphole and downhole parts of the gap sub, thereby providing an extended distance along bore 27 between electrically conductive parts of the gap sub in contact with the drilling fluid flowing in bore 27.

Electronics package 22 may be locked against axial movement within bore 27 in any suitable manner. This may be done, for example, by way of pins, bolts, clamps, or other suitable fasteners. In the embodiment illustrated in FIG. 2, a spider 40 having a rim 40A supported by arms 40B is attached to electronics package 22. Rim 40A engages a ledge or step 41 formed at the end of a counterbore within bore 27. Rim 40A is clamped tightly against ledge 41 by a nut (not shown) that engages internal threads (not shown) on surface 42.

In some embodiments, centralizer 28 is situated to extend along electronics package 22 from spider 40 or other longitudinal support system for electronics package 22 continuously to the opposing end of electronics package 22. In other embodiments one or more sections of centralizing features 28C extend to grip electronics package 22 over at least 70% or at least 80% or at least 90% or at least 95% of a distance from the longitudinal support to the opposing end of electronics package 22.

In some embodiments electronics package 22 has a fixed rotational orientation relative to section 26. For example, in some embodiments spider 40 is keyed, splined, has a shaped bore that engages a shaped shaft on the electronics package 22 or is otherwise non-rotationally mounted to electronics package 22. Spider 40 may also be non-rotationally mounted to section 26, for example by way of a key, splines, shaping of the face or edge of rim 40A that engages corresponding shaping within bore 27 or the like.

In some embodiments electronics package 22 has two or more spiders, electrodes, or other elements that directly engage section 26. For example, electronics package 22 may include an EM telemetry system that has two spaced apart electrical contacts that engage section 26. In such embodiments, a centralizer 28 may extend for a substantial portion of (e.g. at least 50% or at least 65% or at least 75% or at least 80% or substantially the full length of) electronics package 22 between two elements that engage section 26.

Figure 3:
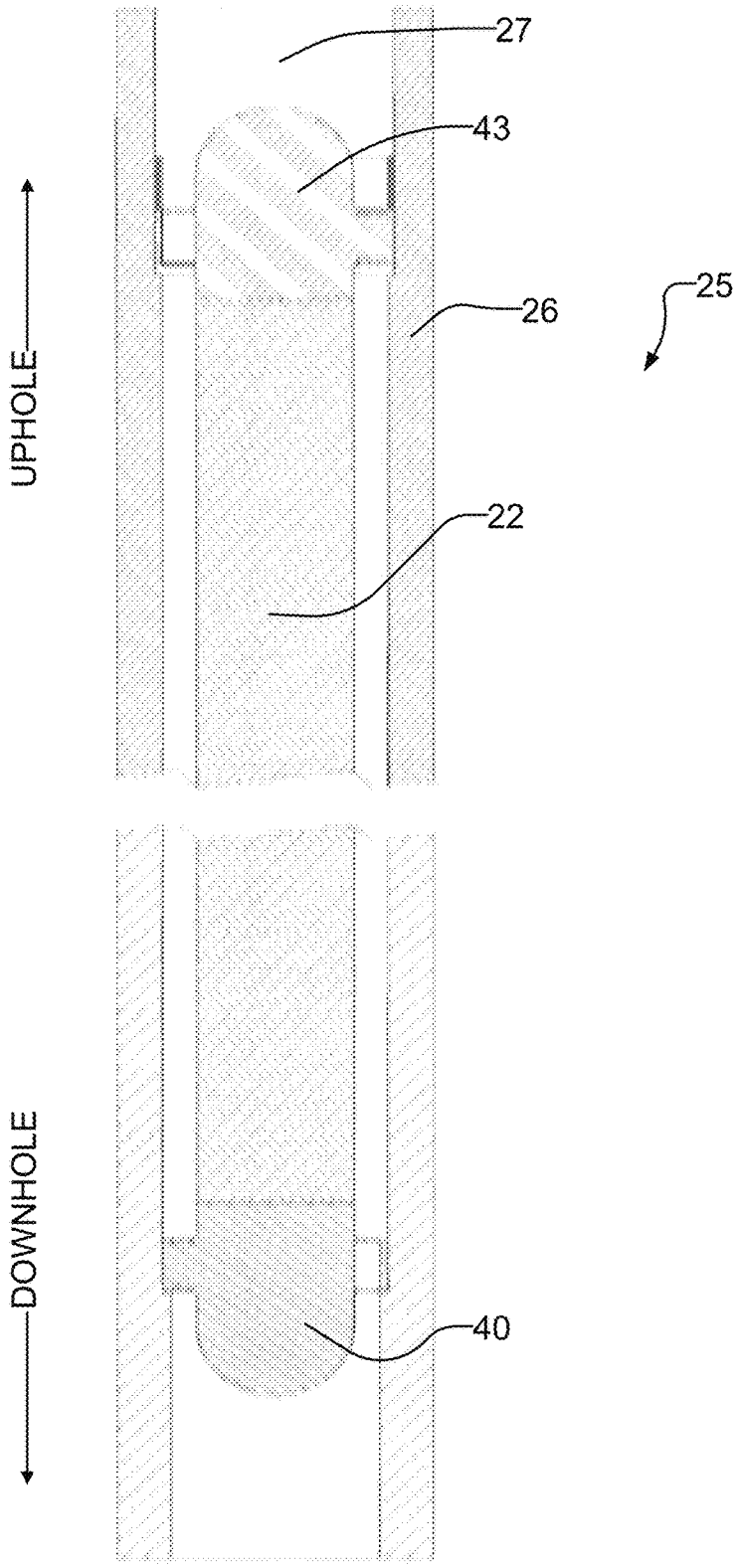
FIG. 3 is a schematic illustration of one embodiment of the invention where an electronic package is supported between two spiders.

In an example embodiment shown in FIG. 3, electronics package 22 is supported between two spiders 40 and 43. Each spider 40 and 43 engages a corresponding landing ledge within bore 27. Each spider 40 and 43 (or either of them) may be non-rotationally coupled to both electronics package 22 and bore 27. A centralizer 28 (not shown in FIG. 3) may be provided between spiders 40 and 43 Optionally spiders 40 and 43 are each spaced longitudinally apart from the ends of centralizer 28 (or from the ends of centralizing features 28C) by a short distance (e.g. up to about ½ meter (18 inches) or so) to encourage laminar flow of drilling fluid through the channels formed by valleys 31.

Centralizers 40 and 43 may optionally be electrically conductive and may provide paths for coupling electrical power and/or electrical signals from electronics package 22 to the parts of section 26 that centralizers 40 and 43 engage. For example, section 26 may comprise a gap sub having electrically conductive parts separated by an electrically-insulating gap. Spiders 40 and 43 may respectively contact parts of the drill string on either side of the gap. A signal generator or other electronics within electronics package 22 may apply telemetry signals or other signals to the gap sub by way of spiders 40 and 43. In an alternative embodiment, centralizer 28 is electrically conducting and provides one conduction path between electronics probe 22 and section 26. One or both of centralizers 40 and 43 may provide another conduction path to section 26.

In some embodiments a centralizer 28 comprises centralizing ridges that extend longitudinally along a part of section 26 between first and second landings and the downhole probe is configured to engage the first and second landings (for example, by way of spiders or other coupling mechanisms). The centralizing ridges may extend along at least 60%, at least 70%, at least 80%, at least 90% or substantially all of the distance between the first and second landings.

A centralizer 28 as described herein may optionally interface non-rotationally to an electronics package 22. For example, the electronics package 22 may have features that project to engage between inwardly-projecting ridges 29 so that the centralizing features prevent rotation of electronics package 22 and/or provide enhanced damping of torsional vibrations of electronics package 22.

In some applications, as drilling progresses, the outer diameter of components of the drill string may change. For example, a well bore may be stepped such that the wellbore is larger in diameter near the surface than it is in its deeper portions. At different stages of drilling a single hole, it may be desirable to install the same downhole probe in drill string sections having different dimensions. A set of centralizers 28 having different outside diameters may be provided. All of the centralizers 28 in the set may have centralizing features 28C dimensioned to receive the same electronics package 22 (or other downhole probe). The set of centralizers 28 as described herein may be provided at a well site.

Moving a downhole probe or other electronics package into a drill string section 26 of a different size may be easily performed at a well site by removing the electronics package from one drill string section, changing a spider or other longitudinal holding device(s) to a size appropriate for the new drill string section 26, inserting an appropriately-dimensioned centralizer into the drill string section 26 and inserting the electronics package into the bore 28B of the centralizer.

For example, a set may be provided comprising: centralizers of different sizes all having centralizing features as described herein to support the same downhole probe. Where the different drill string sections have different bore sizes the set may additionally include spiders or other longitudinal holding devices of different sizes suitable for use with the different drill string sections. The set may, by way of non-limiting example, comprise drill string sections of a plurality of different standard outside diameters such as outside diameters of two or more of: 4¾ inches, 6½ inches, 8 inches, 9½ inches and 11 inches together with spiders or other mechanisms for longitudinally anchoring a probe in the different drill string sections. The centralizers may, by way of non-limiting example, be dimensioned in length to support a probe having a length in the range of 2 to 20 meters.

Embodiments as described above may provide one or more of the following advantages. Centralizing features 28C may extend for the full length of the electronics package 22 or any desired part of that length. Especially where centralizing features 28C support electronics package 22 from four or more sides, electronics package 22 is mechanically coupled to section 26 in all directions, thereby reducing the possibility for localized bending of the electronics package 22 under severe shock and vibration. Reducing local bending of electronics package 22 can facilitate longevity of mechanical and electrical components and reduce the possibility of catastrophic failure of the housing of electronics assembly 22 or other components internal to electronics package 22 due to fatigue. Good mechanical coupling of electronics package 22 to section 26 helps to raise the resonant frequencies of electronics package 22 and alleviate damage to components resulting from 'pinging' (excitation of vibrations by shocks). Centralizer 28 can accommodate slick electronics packages 22 and can allow an electronics package 22 to be removable while downhole (since centralizing features 28C can be made so that they do not interfere with withdrawal of an electronics package 22 in a longitudinal direction).

One example application of apparatus as described herein is directional drilling. In directional drilling the section of a drill string containing a downhole probe may be non-vertical. Centralizer 28 can counteract gravitational sag and maintain electronics package 22 central in bore 27 and thereby maintain sensors in the downhole probe true to the bore of the drill string during directional drilling or other applications where bore 27 is horizontal or otherwise non-vertical.

Apparatus as described herein may be applied in a wide range of subsurface drilling applications. For example, the apparatus may be applied to support downhole electronics that provide telemetry in logging while drilling ('LWD') and/or measuring while drilling ('MWD') telemetry applications. The described apparatus is not limited to use in these contexts, however.

A wide range of alternatives are possible. For example, it is not mandatory that centralizer 28 be a single component. In some embodiments centralizer 28 comprises a plurality of sections that can be coupled together to support a desired length of downhole probe.

While it is convenient to make centralizer 28 of an extruded plastic, centralizer 28 may be made of other materials as well. For example, in an alternative embodiment, centralizer 28 is extruded from aluminum. A vibration damping layer may be provided on the cylindrical outer surface of centralizer 28. Electronics package 28 may be slick or may, in the alternative be coated with a layer of a vibration damping material.

As noted above, a centralizer 28 may be dimensioned for a slip fit into a drill string section 26. A centralizer 28 may be supported against axial motion within the drill string in any suitable way. In some embodiments a landing, spider, or other support is provided downhole from the centralizer. The centralizer may slide in a downhole direction until it abuts the landing, spider or other support. In some embodiments axial motion of the centralizer is further limited by a spider or other structure which limits travel of the centralizer in an uphole direction. In some embodiments the centralizer is captured between two supports that also support a downhole probe. for example, as described above, a centralizer may be captured between two spiders that support an electronics package or other downhole probe that passes through and is supported by the centralizer.

Interpretation of Terms

Unless the context clearly requires otherwise, throughout the description and the claims:

"comprise," "comprising," and the like are to be construed in an inclusive sense, as opposed to an exclusive or exhaustive sense; that is to say, in the sense of "including, but not limited to".

"connected," "coupled," or any variant thereof, means any connection or coupling, either direct or indirect, between two or more elements; the coupling or connection between the elements can be physical, logical, or a combination thereof.

"herein," "above," "below," and words of similar import, when used to describe this specification shall refer to this specification as a whole and not to any particular portions of this specification.

"or," in reference to a list of two or more items, covers all of the following interpretations of the word: any of the items in the list, all of the items in the list, and any combination of the items in the list.

the singular forms "a", "an" and "the" also include the meaning of any appropriate plural forms.

Words that indicate directions such as "vertical", "transverse", "horizontal", "upward", "downward", "forward", "backward", "inward", "outward", "left", "right", "front", "back", "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. A downhole assembly comprising:

a drill string section having a bore extending longitudinally through the drill string section;

a tubular centralizer removably disposed in the bore of the drill string section, the centralizer comprising a cylindrical body having a cylindrical outer surface dimensioned for a slip fit in the drill string section and a bore extending longitudinally from an uphole end of the centralizer to a down hole end of the centralizer; and a downhole probe located in the bore of the centralizer;

wherein the centralizer comprises centralizing ridges extending inwardly into the bore of the centralizer to contact the downhole probe and support the downhole probe in the bore of the centralizer, the centralizing ridges being arranged to provide passages for the flow of drilling fluid around an outside of the downhole probe between the centralizing ridges; and wherein the downhole assembly comprises a layer of a vibration damping material between the centralizing ridges and the downhole probe.

2. The downhole assembly according to claim 1 wherein the centralizing ridges extend parallel to a longitudinal centerline of the bore of the centralizer.

3. The downhole assembly according to claim 1 wherein the centralizing ridges extend helically within the bore of the centralizer.

4. The downhole assembly according to claim 1 wherein the ridges are equally spaced apart from one another around the circumference of the bore of the centralizer.

5. The downhole assembly according to claim 4 wherein there are 2 to 8 centralizing ridges.

6. The downhole assembly according to claim 1 wherein, in transverse cross-section, the centralizing ridges are mirror symmetrical about an axis passing through a longitudinal centerline of the centralizer.

7. The downhole assembly according to claim 1 wherein, in a transverse cross-section of the centralizer, the centralizing ridges have profiles in the form of rounded lobes.

8. The downhole assembly according to claim 7 wherein each of the rounded lobes is mirror symmetrical about an axis passing through a longitudinal centerline of the bore of the centralizer.

9. The downhole assembly according to claim 1 wherein portions of the centralizing ridges that contact the downhole probe comprise V-grooves extending longitudinally within the bore of the centralizer.

10. The downhole assembly according to claim 1 wherein portions of the centralizing ridges that contact the downhole probe are formed to conform to a shape of an outer surface of the downhole probe.

11. The downhole assembly according to claim 1 wherein the vibration damping material comprises a layer attached to the centralizing ridges.

12. The downhole assembly according to claim 1 wherein the layer extends circumferentially around the bore wall of the bore of the centralizer.

13. The downhole assembly according to claim 1 wherein the vibration damping material comprises a layer attached to the downhole probe.

14. The downhole assembly according to claim 1 wherein the vibration damping material is electrically insulating.

15. The downhole assembly according to claim 14 wherein the vibration damping material comprises rubber, a plastic or an elastomer.

16. The downhole assembly according to claim 1 wherein the vibration damping material comprises a pre-formed sleeve.

17. The downhole assembly according to claim 16 wherein the sleeve is slidably removable from the probe.

18. The downhole assembly according to claim 16 wherein the sleeve is extruded or injection molded.

19. The downhole assembly according to claim 16 wherein the sleeve is configured to engage the centralizing ridges, the engagement limiting rotation of the sleeve relative to the centralizer.

20. The downhole assembly according to claim 1 wherein, in cross-section the centralizing ridges have 3-fold rotational symmetry.

21. The downhole assembly according to claim 1 wherein the downhole probe comprises an electronics package.

22. The downhole assembly according to claim 1 wherein the downhole probe comprises a metal housing and the metal housing is harder than a material of the centralizing ridges.

23. The downhole assembly according to claim 1 wherein the downhole probe comprises a cylindrical housing.

24. The downhole assembly according to claim 1 wherein the downhole probe has a length in the range of 1 to 20 meters.

25. The downhole assembly according to claim 1 wherein the centralizing ridges extend to support the downhole probe substantially continuously along at least 60% of a length of the downhole probe.

26. The downhole assembly according to claim 1 wherein the centralizing ridges extend to support the downhole probe substantially continuously along at least 70% of a length of the downhole probe.

27. The downhole assembly according to claim 1 wherein the centralizing ridges extend to support the downhole probe substantially continuously along at least 80% of a length of the downhole probe.

28. The downhole assembly according to claim 1 wherein the centralizing ridges extend to support the downhole probe substantially continuously along substantially all of the length of the downhole probe.

29. The downhole assembly according to claim 1 wherein the downhole probe is an interference fit between the centralizing ridges.

30. The downhole assembly according to claim 1 wherein the downhole probe and layer of vibration damping material are an interference fit between the centralizing ridges.

31. The downhole assembly according to claim 1 wherein the downhole probe is a tight sliding fit between the centralizing ridges.

32. The downhole assembly according to claim 11 wherein the downhole probe and layer of vibration damping material are tight sliding fit between the centralizing ridges.

33. The downhole assembly according to claim 1 comprising an uphole coupling at an uphole end of the drill string section and a downhole coupling at a downhole end of the drill string section.

34. The downhole assembly according to claim 33 wherein the uphole and downhole couplings comprise threaded couplings.

35. A downhole assembly comprising:

a drill string section having a bore extending longitudinally through the drill string section;

a tubular centralizer removably disposed in the bore of the drill string section, the centralizer comprising a cylindrical body having a cylindrical outer surface dimensioned for a slip fit in the drill string section and a bore extending longitudinally from an uphole end of the centralizer to a down hole end of the centralizer; and a downhole probe located in the bore of the centralizer;

wherein the centralizer comprises centralizing ridges extending inwardly into the bore of the centralizer to contact the downhole probe and support the downhole probe in the bore of the centralizer, the centralizing ridges being arranged to provide passages for the flow of drilling fluid around an outside of the downhole probe between the centralizing ridges;

wherein the section comprises a landing adjacent to the uphole or downhole end of the centralizer and the downhole probe is configured to engage the landing; and wherein the downhole probe comprises a spider configured to engage the landing.

36. The downhole assembly according to claim 35 wherein the landing comprises a step in the bore of the section.

37. A downhole assembly comprising:

a drill string section having a bore extending longitudinally through the drill string section;

a tubular centralizer removably disposed in the bore of the drill string section, the centralizer comprising a cylindrical body having a cylindrical outer surface dimensioned for a slip fit in the drill string section and a bore extending longitudinally from an uphole end of the centralizer to a down hole end of the centralizer; and a downhole probe located in the bore of the centralizer;

wherein the centralizer comprises centralizing ridges extending inwardly into the bore of the centralizer to contact the downhole probe and support the downhole probe in the bore of the centralizer, the centralizing ridges being arranged to provide passages for the flow of drilling fluid around an outside of the downhole probe between the centralizing ridges; and wherein the centralizer extends longitudinally along a part of the section between first and second landings and the downhole probe is configured to engage the first and second landings.

38. The downhole assembly according to claim 37 wherein the centralizer extends along at least 60% of the distance between the first and second landings.

39. The downhole assembly according to claim 38 wherein the centralizer extends substantially continuously to support the downhole probe over at least 60% of the distance between the first and second landings.

40. A downhole assembly comprising:

a drill string section having a bore extending longitudinally through the drill string section;

a tubular centralizer removably disposed in the bore of the drill string section, the centralizer comprising a cylindrical body having a cylindrical outer surface dimensioned for a slip fit in the drill string section and a bore extending longitudinally from an uphole end of the centralizer to a down hole end of the centralizer; and a downhole probe located in the bore of the centralizer;

wherein the centralizer comprises centralizing ridges extending inwardly into the bore of the centralizer to contact the downhole probe and support the downhole probe in the bore of the centralizer, the centralizing ridges being arranged to provide passages for the flow of drilling fluid around an outside of the downhole probe between the centralizing ridges; and wherein the section comprises a gap sub having an electrically-conducting uphole part, an electrically-conducting downhole part and an electrically insulating part between the uphole and downhole parts.

41. The downhole assembly according to claim 40 wherein the downhole probe extends across the electrically insulating part of the gap sub and the centralizer is electrically insulating and extends between the uphole and downhole parts of the gap sub.

42. The downhole assembly according to claim 40 wherein the downhole probe extends across the electrically insulating part of the gap sub and the centralizing ridges comprise four longitudinally-extending ridges extending radially-inwardly into the bore of the centralizer.

43. A downhole assembly comprising:

a drill string section having a bore extending longitudinally through the drill string section;

a tubular centralizer removably disposed in the bore of the drill string section, the centralizer comprising a cylindrical body having a cylindrical outer surface dimensioned for a slip fit in the drill string section and a bore extending longitudinally from an uphole end of the centralizer to a downhole end of the centralizer; and a downhole probe located in the bore of the centralizer;

wherein the centralizer comprises centralizing ridges extending inwardly into the bore of the centralizer to contact the downhole probe and support the downhole probe in the bore of the centralizer, the centralizing ridges being arranged to provide passages for the flow of drilling fluid around an outside of the downhole probe between the centralizing ridges; and wherein the downhole probe has a resonant frequency f when the downhole probe is not engaged in the drill string section and the resonant frequency of the down hole probe is increased to $f'>f$ as a result of mechanical coupling between the downhole probe and the drill string section by way of the centralizer when the probe is engaged between the centralizing ridges.

44. A downhole assembly comprising:

a drill string section having a bore extending longitudinally through the drill string section;

a tubular centralizer removably disposed in the bore of the drill string section, the centralizer comprising a cylindrical body having a cylindrical outer surface dimensioned for a slip fit in the drill string section and a bore extending longitudinally from an uphole end of the centralizer to a downhole end of the centralizer;

a downhole probe located in the bore of the centralizer; and a layer of vibration damping material between the drill string section and the centralizer;

wherein the centralizer comprises centralizing ridges extending inwardly into the bore of the centralizer to contact the downhole probe and support the downhole probe in the bore of the centralizer, the centralizing ridges being arranged to provide passages for the flow of drilling fluid around an outside of the downhole probe between the centralizing ridges.

45. The downhole assembly according to claim 44 wherein the vibration damping material comprises a layer attached to the centralizer.

46. The downhole assembly according to claim 44 wherein the vibration damping material comprises a layer attached to the bore of the section.

47. The downhole assembly according to claim 44 wherein the vibration damping material is electrically insulating.

48. The downhole assembly according to claim 44 wherein the vibration damping material between the drill string section and the centralizer comprises rubber, a plastic or an elastomer.

49. The downhole assembly according to claim 44 wherein the vibration damping material between the drill string section and the centralizer comprises a pre-formed sleeve.

50. The downhole assembly according to claim 49 wherein the sleeve is slidably removable from the centralizer.

51. The downhole assembly according to claim 49 wherein the sleeve is extruded or injection molded.

52. A downhole assembly comprising:

a drill string section having a bore extending longitudinally through the drill string section;

a tubular centralizer removably disposed in the bore of the drill string section, the centralizer comprising a cylindrical body having a bore extending longitudinally from an uphole end of the centralizer to a down hole end of the centralizer; and a downhole probe located in the bore of the centralizer;

wherein the centralizer comprises centralizing ridges extending inwardly into the bore of the centralizer to contact the downhole probe and support the downhole probe in the bore of the centralizer, the centralizing ridges being arranged to provide passages for the flow of drilling fluid around an outside of the downhole probe between the centralizing ridges;

wherein the centralizer is dimensioned for a slip fit in the drill string section, the centralizer extends longitudinally along a part of the section between first and second landings and the downhole probe is configured to engage the first and second landings.

53. The downhole assembly according to claim 52 wherein the centralizer extends along at least 60% of the distance between the first and second landings.

54. The downhole assembly according to claim 53 wherein the centralizer extends substantially continuously to support the downhole probe over at least 60% of the distance between the first and second landings.

55. The downhole assembly according to claim 52 wherein the downhole probe is an interference fit between the centralizing ridges.

56. The downhole assembly according to claim 52 comprising a layer of a vibration damping material between the centralizing ridges and the downhole probe.

57. The downhole assembly according to claim 56 wherein the vibration damping material comprises a layer attached to the downhole probe.

58. The downhole assembly according to claim 56 wherein the vibration damping material is electrically insulating.

59. The downhole assembly according to claim 58 wherein the vibration damping material comprises rubber, a plastic or an elastomer.

60. The downhole assembly according to claim 56 wherein the vibration damping material comprises a preformed sleeve.

61. The downhole assembly according to claim 60 wherein the sleeve is slidably removable from the probe.

* * * * *